United States Patent [19]

Hsieh

[11] Patent Number: 4,630,400

[45] Date of Patent: Dec. 23, 1986

[54] SASHES FOR A CLOSURE

[76] Inventor: Ming-Hung Hsieh, 179 Sec. 2, Chung Hua Rd., Tai Chung City, Taiwan

[21] Appl. No.: 715,099

[22] Filed: Mar. 22, 1985

[51] Int. Cl.[4] ..... E05D 13/00

[52] U.S. Cl. ..... 49/425; 49/501; 49/504

[58] Field of Search ..... 49/501, 504, 404, 425

[56] References Cited

U.S. PATENT DOCUMENTS 3,370,383 2/1968 Riegelman ..... 49/425
4,106,239 8/1978 Bancroft et al. ..... 49/449
4,286,716 9/1981 Budich et al. ..... 49/504 X
4,341,043 7/1982 Yamamoto et al. ..... 49/449

*Primary Examiner*—Kenneth Downey
*Attorney, Agent, or Firm*—Ladas & Parry

[57] ABSTRACT

A closure with sashes includes a closure body, an inner sash enclosing around the closure body and including a first upper rail, a first lower rail, a first left stile and a first right stile and an outer sash matchable with the inner sash, including a second upper rail, a second lower rail, a second left stile and a second right stile and adapted to be mounted on a wall of a building wherein there exists a characteristic that the first upper rail is identical to the first lower rail in shape.

14 Claims, 34 Drawing Figures

SASHES FOR A CLOSURE

BACKGROUND OF THE INVENTION

The present invention relates to a closure, e.g. a door or the like, and more particularly to a closure with sashes.

The known sashes for a closure, e.g. a door(window) shown in FIG. 1, have their sectional views as shown in FIGS. 2 & 3. Such sashes can be criticized in several aspects set out as follows:

(1) Different structural rails or stiles must be used for such sashes which, in this instance, include an upper rail 101, a lower rail 102 and a common stile 103 of the outer sash and upper rail 111, a lower rail 112, a side stile 113 and a meeting stile 114 of the inner sash, all of which amount to 7 different structures. It would be highly appreciated if one could minimize the numbers of different structures.

(2) Owing to the structural nature of upper rail 101 as shown in FIG. 2, the degree that upper rail 111 can be lifted and inclined to enable the inner sash to be detached from upper rail 101 is quite limited. Thus, the disengagement between the inner and outer sashes is difficult.

(3) The rooms 105, 106 formed between upper rails 101, 111 are not equally divided. Therefore, they cannot be fully packed by the same sealing piece for the air(water)-tight purpose which is desired in some circumstances, e.g. an air-conditioned chamber.

(4) For mounting therein a roller 131, lower rail 112 must be provided with a receiving room 115. However, roller 131 cannot wholly occupy receiving room 115 to admit the wind/rain penetrating therethrough into the room intended to be closed by the closure.

(5) For guiding roller 131, two guiding rails 109 must be formed on lower rail 102. Thus, side stile 113 and meeting stile 114 must be notched for passing rails 109, which in turn adds to mitigate the air(-water)-tight capability of such sashes. One may have had the experience of a door or window being whistling which was caused by the fact that the sashes thereof do not have a good air(water)-tight capability. In addition, two water accumulating rooms 132, 133 are formed beside rails 109 for discharging the water possibly contained therein. Generally, rails 109 are cut down to the upper surface of the bottom plate 108 at predetermined positions, which, also, enhances to reduce the air(-water)-tight effect of such sashes.

(6) With two L-shaped flanges 115 respectively provided on two meeting stiles 114 to engage with each other, the air(water)-tight effect is not adequate. Besides, the strength of L-shaped flanges 115 for enduring the meeting impact of meeting stiles 114 is often found to fall short.

(7) The rails and stiles of such sashes when fit up on a wall 150 form a shoulder portion 121 upon where it is an inconvenience to be decorated, e.g. coated, thereon.

(8) Such sashes can not mount thereon a grille.

(9) It is compulsory that the ends of upper rail 101, lower rail 102 be provided with plastic stoppers for preventing the collision between common stile 103 and side stile 113.

In view of the above facts, it is attempted by the applicant to deal with the above situations.

SUMMARY OF THE INVENTION

It is therefore an object of the present invention to provide sashes for a closure which include minimized different structural rails and stiles.

It is therefore another object of the present invention to provide sashes for a closure which provide an optimized air(water)-tight effect.

It is further an object of the present invention to provide sashes for a closure which can be fitted easily onto a wall.

It is still an object of the present invention to provide sashes for a closure which can additionally mount thereon a grille with an extending structure.

It is yet an object of the present invention to provide sashes for a closure which enable the wall on which it is fitted to be capable of being decorated easily.

It is additionally an object of the present invention to provide sashes for a closure which remains silent on a windy day.

According to the present invention, sashes for a closure comprise an inner sash including a first upper rail, a first lower rail, a first left stile and a first right stile and adapted to enclose around a closure body and an outer sash matchable with the inner sash, including a second upper rail, a second lower rail, a second left stile and a second right stile and adapted to be mounted on a wall of a building wherein there is a characteristic that the first upper rail is indentical to the first lower rail in shape.

Preferably the second left stile is indentical to the second right stile in shape.

The second upper rail can include a central vertical diaphragm plate for separating the cross-sectional area of the second upper rail into two equal parts. Generally one of the first left stile and first right stile is a meeting stile which has a meeting side near the line constituted by the middle points of the cross-sections of the second left and right stiles and has a cross-section including a first end formed thereon a first receiving room for receiving and securing therein a first side of the closure body, an L-shaped flange attached to the outer surface of the meeting side, near the first receiving room and having vertical portion thereof parallel to the outer surface to form therebetween a receiving space, a second end formed thereon a second receiving room and a first grooved channel formed on the outer surface and near the second receiving room.

The inner sash being rotated 90 degress with the other one of the first left stile and first right stile kept vertically spaced from and parallel to the meeting stile is still capable of matching with the outer sash. Preferably the sashes further include a first sealing piece mounted in the first grooved channel and having a width capable of reaching the line and a straight flange secured to the end edge of the first grooved channel and having a width extending to terminate on the line.

Preferably the first sealing piece has a length equal to that of the meeting stile.

Preferably the sashes further include a cushioning piece and a second sealing piece. The inner side of each of the second left and right stiles is provided with a protrusion. The cross-section of the other one of the first left and right stiles has a first end formed thereon a first receiving room for receiving and securing therein a second side of the closure body and a second end formed thereon a second receiving room receiving therein the cushioning piece by which the impact force between the the other one of the first left and right stiles and either one of the second left and right stiles is cushioned when the the other one of the first left and right stiles is impacted upon the one of the second left and right stiles and the cushioning piece is impacted upon the protrusion. The inner side of the second receiving room receiving the cushioning piece is provided with a second grooved channel which receives therein the second sealing piece which is capable of engaging with the protrusion for air-tight purposes when the protrusion engages with the cushioning piece.

Preferably the second lower rail includes two parallel shallow socket channels each of which is adapted to slide thereon a roller which carries the closure.

Preferably the sashes further includes two third receiving rooms each of which is formed between the first and second receiving rooms of either one of the first left and right stiles, two axial protrusions respectively provided on the two sides of the roller and a roller mounting piece capable of being received in one of the third receiving rooms, having an indentation which has a shape corresponding to that of the roller for receiving it therein and has a depth smaller than the diameter of the roller so that the rest portion of the roller is not received in the indentation but can slide on the arc surface of one of the shallow socket channels, and having a grooved channel alongside the outer side, which is the side near the outside of the building, of one of the shallow socket channels.

Preferably the cross-section of the first upper rail includes a first end formed a first receiving room for receiving and securing therein a third side of the closure body and a second end having a third grooved channel positioned alongdside the central vertical diaphragm plate and a fourth grooved channel near one side of the second upper rail.

Preferably the sashes further includes a fourth sealing piece capable of being received in the fourth grooved channel and having a width capable of reaching the inner surface of the one side for air-tight purposes.

Preferably the cross-section of the first lower rail is identical to that of the first upper rail, is disposed upsidedown and includes a corresonding first end formed a first receiving room for receiving and securing therein a fourth side of the closure body and a corresponding second end having a corresponding third grooved channel positioned alongside the outer side of one of the shallow socket channels and a corresponding fourth grooved channel capable of being positioned above the inner side, which is the side near the inside of the building, of one of the shallow socket channels.

Preferably the sashes further includes a third sealing capable of being received in the corresponding third grooved channel and having a width capable of reaching the outer surface of the outer side of the one of the shallow socket channels for air-tight purposes.

Preferably the sashes further includes an insert which is capable of packing the room formed among the central vertical diaphragm plate, the inner portion of the second upper rail and the area above one of the first left and right stiles.

Preferably the sashes further includes a stabilizing piece, which includes a first end capable of engaging with the inner side of one of the shallow socket channels and a second end capable of engaging with the corresponding fourth grooved channel, for ensuriung that the roller will not fall out of the shallow socket channel upon which it slides.

Preferably the outer side of the second upper rail includes a first vertical plate and a second vertical plate which is parallel to the first vertical plate and cooperates with the first vertical plate to form a first guiding room therebetween.

Preferably the outer side of the second lower rail is mounted thereon a curved flange to form thereon a second guiding room.

Certainly the sashes can further include a netted closure with an inner sash which has an upper rail capable of being guided to slide within the first guiding room, has a lower rail capable of being guided to slide within the second guiding room and includes a rail-stile connector which includes a first protrusion capable of engaging with a rail of the inner sash of the netted closure, a second protrusion positioned perpendicular to the first protrusion and capable of engaging with a stile of the inner sash of the netted closure and a C-shaped flange which is attached to the outer surface of the outer side of the connector, has the central portion thereof capable of being parallel to the outer surface of the connecter and has the lower portion thereof being capable of engaging with the bottom surface of the curved flange.

Preferably the sashes further includes a lock body capable of being secured in the second receiving room of the meeting stile and capable of being adpated to engage with a plate lock hook which is capable of fixedly hooking thereon the lock body.

Preferably the sashes further includes the plate lock hook which includes a lower portion which is capable of being inserted into the receiving space and has a first side capable of engaging with the outer surface of the meeting side and a second side which is the side opposite to the first side and capable of cooperating with the vertical portion of the L-shaped flange to form therebetween a screwing space by which the plate lock hook is secured in the receiving space when the screwed space is adapted to be screwed into by a screw.

Certainly the sashes can further include an intermediate rail which is positioned between and parallel to the second upper rail and the second lower rail and is constituted by a third lower rail indentical to the second lower rail in cross-section and a third upper rail indentical to the second upper rail in cross-section with the third upper rail positioned right beneath and parallel to the third lower rail.

Certainly the sashes can further include a grille with a frame which includes a fourth upper rail, a fourth lower rail, a fourth left stile and a fourth right stile all of which bear the same cross-section which includes a first end formed a receiving room for receiving therein a side of the grille and a second end having the outer side thereof formed a grooved channel adapted to receive therein a side of a netted closure and the inner side thereof formed a fifth grooved channel.

Certainly, the sashes can further include an extending rail which is engagable with and capable of being secured outside of and against one of the first guiding room and second guiding room.

Certainly, the sashes can further include a C-shaped piece. The second vertical plane has a second protrusion. The inner side of the extending rail has a corresponding protrusion capable of engaging with the second protrusion. The outer side of the extending rail has a third vertical plate positioned at the outside of the third upper rail and a sixth grooved channel positioned right above the fifth grooved channel so that the C-shpaed piece has two end portions thereof capable of being securely engaging with the fifth and sixth grooved channels respectively.

Certainly, the sashes can further include an extending stile which is engagable with and capable of being secured outside of and against one of the outer side, the inner surface of which is provided with two third protrusions, of the second left stile when viewing from the outside of the building and the outer side of the second right stile.

Preferably the inner side of the extending stile is provided with two corresponding protrusions which are capable of engaging with the third protrusions respectively to enable the extending stile engagable with and capable of being secured outside of and against the outer side of the second left stile and the outer side of the extending stile bears a cross-section identical to that of the outer side of the extending rail.

Certainly, the cross-section of the second upper rail can have the central portion thereof been lengthened to form a central guiding room which is capable of guiding therein the first upper rail. The cross-section of the second lower rail can have the central portion thereof lengthened to form thereon a third shallow socket channel which is similar to either one of the shallow socket channels in structure. The cross-section of the second left stile can have the central portion thereof lengthened by a distance equal to that lengthened in the cross-section of either one of the second upper and lower rails.

Preferably each of the inner side of the second upper rail, the inner side of the intermediate rail, the inner side of the second lower rail, the inner side of the second left stile, which is the stile positioned at the left side when viewing from the outside of the building, and the inner side of the second right stile is provided with a side frame the side surface of the inner side of which is incapable of being submerged into the plane which is constituted by the surface of the inner side of the wall.

Preferably the side, which is the side opposite to the meeting side, of the meeting stile is provided with a side frame which when positioned in the inner side of the meeting stile is capable of being coplanar with the side frames of said outer sash.

The structure of the outer sash above described can be incorporated into being used for sashes for a revolvable closure which can further include an extending structure which is capable of being disposed upon any one of the second upper rail, lower rail, left stile and right stile of the outer sash, an inner sash capable of, through the extending structure, matching with the outer sash and a sliding mechanism which is secured between the outer sash and the extending structure for enabling the inner sash to swing either inwardly or outwardly with respect to the outer sash.

Preferably, such sashes for a revolvable closure further includes a sealing piece. The extending structure includes a plate protrusion which further includes a grooved channel which can receive therein the sealing piece which can sealingly engage with the inner sash.

Certainly, such sashes for a revolvable closure can further include a netted closure with an enclosing sash. The plate protrusion includes a cylindrical protrusion formed on the side opposite to that forming the grooved channel. The enclosing sash includes a third upper rail, a third lower rail, a third left stile and a third right stile, between each rail and stile of which there is a rail-stile connector having an arc flange matchable with the cylindrical protrusion with one of the four arc flanges of the four connecters capable of being revolvably and firmly engaging with the cylindrical protrusion.

The present invention may best be understood with reference to the accompanying drawings, in which:

DETAILED DESCRIPTION OF THE PREFERRED EMBODIMENT

Figure 1:
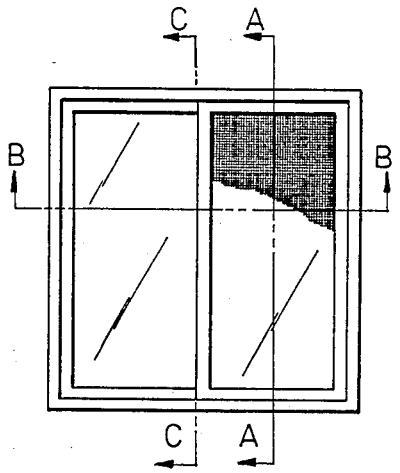
FIG. 1 is a front view of a closure of the sliding type.
Figure 2:
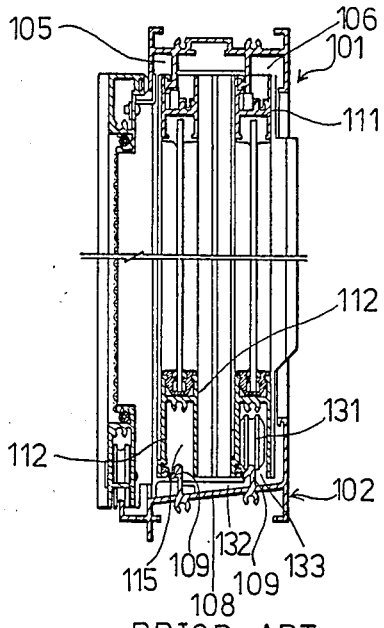
PRIOR ART FIG. 2
FIG. 2 is a sectional view showing the known structure for the closure shown in FIG. 1 along A—A direction.
Figure 3:
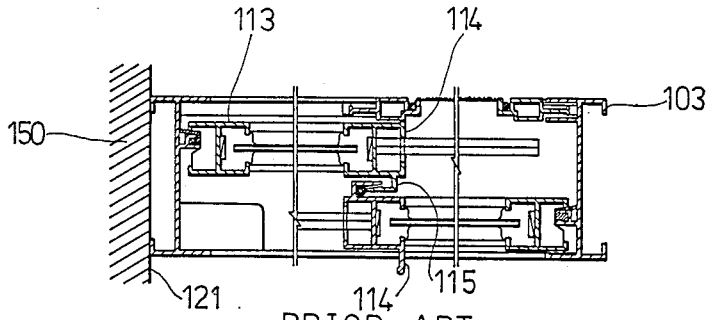
PRIOR ART FIG. 3
FIG. 3 is a sectional view showing the known structure for the closure shown in FIG. 1 along B—B direction.
Figure 4:
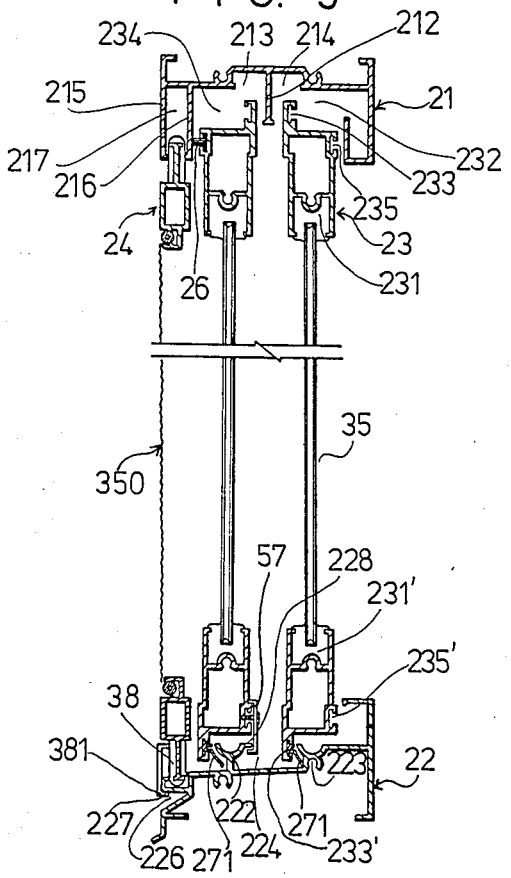
FIG. 4 is a sectional view showing a structure of the present invention for the closure shown in FIG. 1 along A—A direction.
Figure 5:
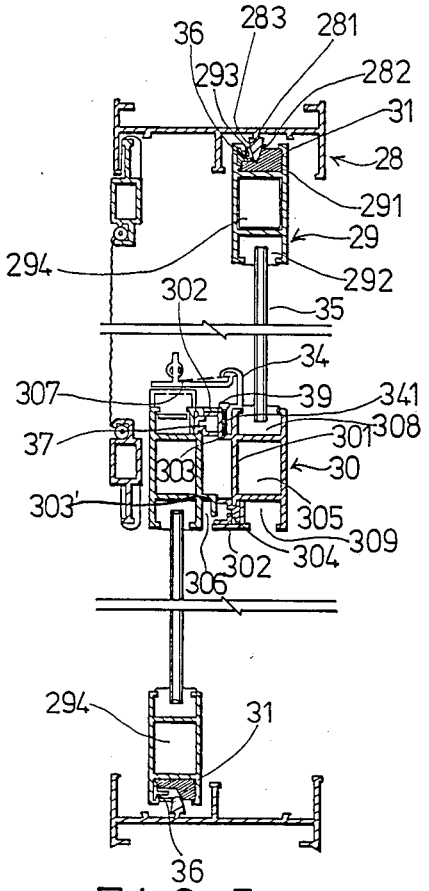
FIG. 5 is a sectional view showing a structure of the present invention for the closure shown in FIG. 1 along B—B direction.
Figure 11:
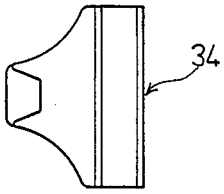
FIG. 11 is a front view showing a plate lock hook of the present invention for engaging with a lock body to lock the closure.
Figure 10:
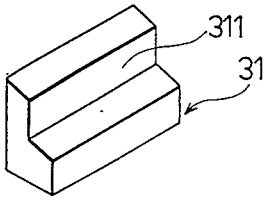
FIG. 10 is a perspective view showing a cushioning piece for cushioning the impact force between the first left or right stile and the second left or right stile of the present invention.
Figure 6:
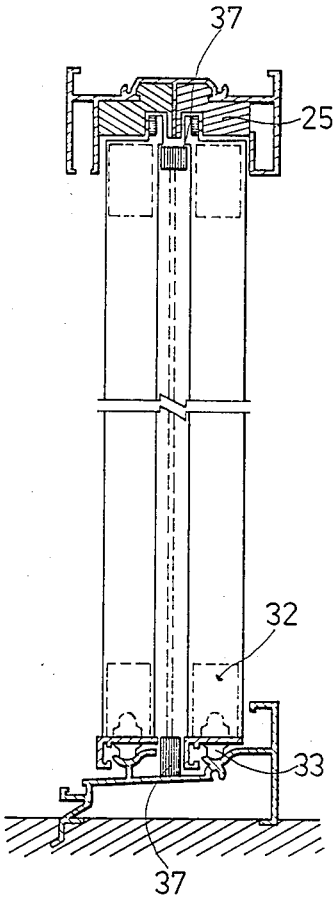
FIG. 6 is a sectional view showing a structure of the present invention for the closure shown in FIG. 1 along C—C direction.
Figure 9:
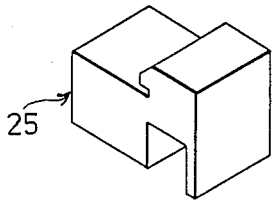
FIG. 9 is a perspective view showing an insert which is capable of packing the area formed among a central vertical diaphragm plate of the second upper rail, the inner portion of the second upper rail and the area above either one of the first left and right stiles of the present invention.
Figure 7:
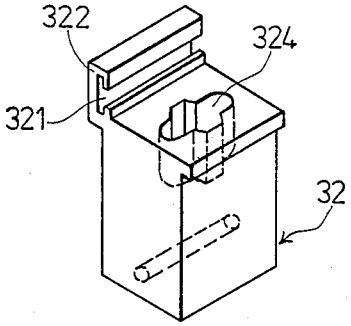
FIG. 7 is a perspective view of a roller mounting piece for mounting therein a roller of the present invention.
Figure 8:
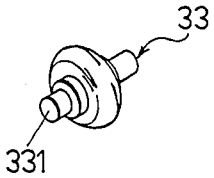
FIG. 8 is a perspective view showing a roller for carrying the load of a closure of the present invention.
Figure 12:
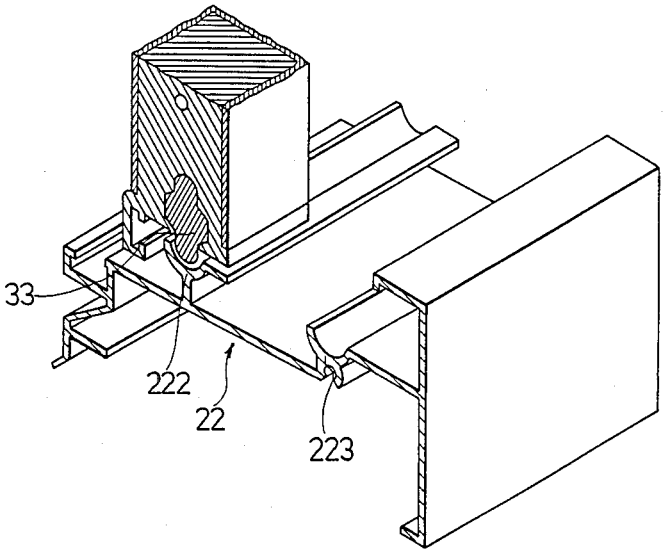
FIG. 12 is a sectional view showing the cooperation of a roller, a roller mounting piece and a second lower rail of the present invention.
Figure 17:
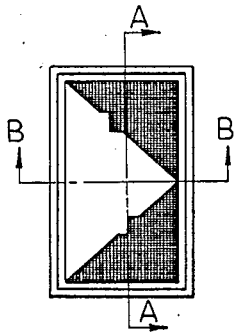
FIG. 17 is a front view showing a revolvable closure.
Figure 13:
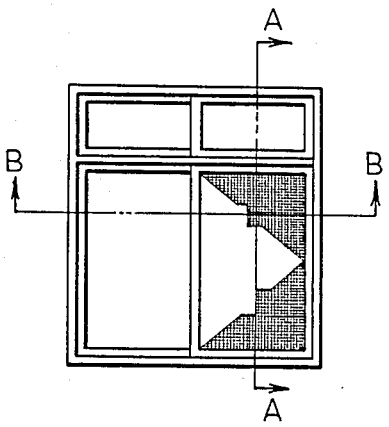
FIG. 13 is a front view showing another closure of the sliding type.
Figure 14:
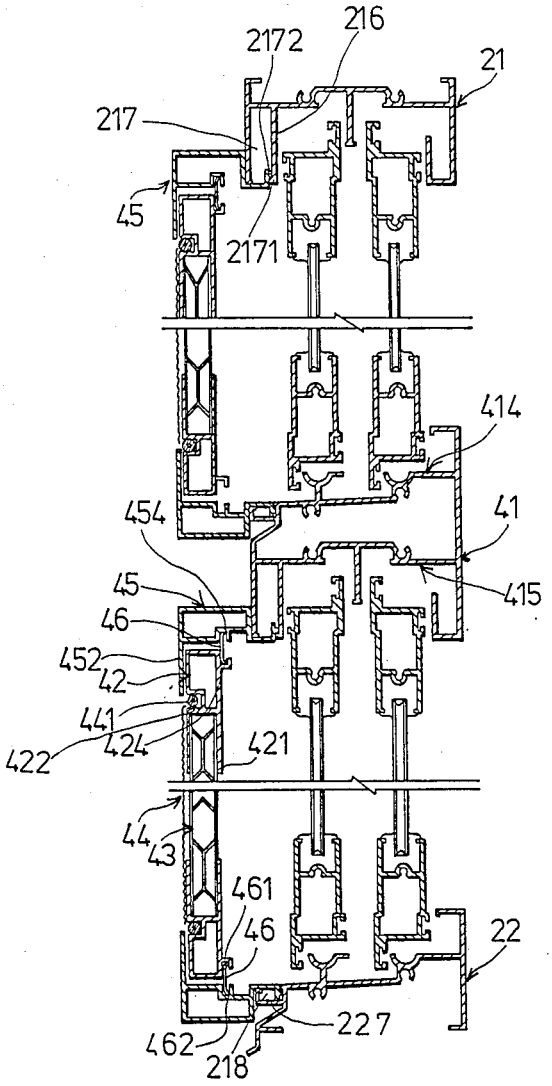
FIG. 14 is a sectional view showing a structure of the present invention for the type of the closure shown in FIG. 13 along the A—A direction.
Figure 15:
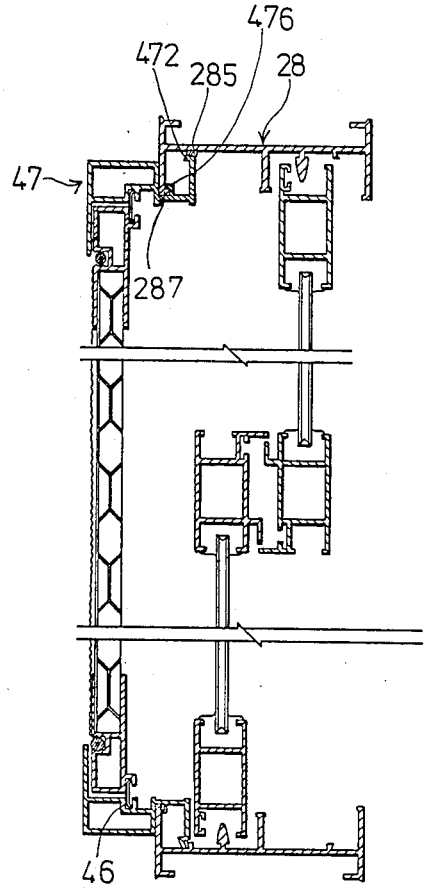
FIG. 15 is a sectional view showing a structure of the present invention for the type of the closure shown in FIG. 14 along the B—B direction.
Figure 25:
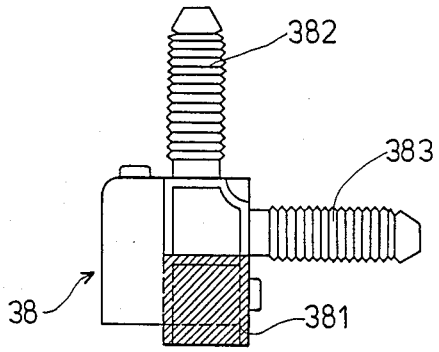
FIG. 25 is a front view showing a rail-stile connector for an inner sash of a netted closure in connection with the type of closure shown in FIG. 22.

Referring now to FIGS. 1, 4 & 5, there are shown sashes for a closure according to the present invention which includes an inner sash including a first upper rail 23, a first lower rail having the same structure as that of rail 23, a first left(right) stile 29 and a first right(left) stile being a meeting stile 30 and adapted to enclose a closure body 35 and an outer sash matchable with the inner sash, including a second upper rail 21, a second lower rail 22, a second left stile 28 and a second right stile having a structural shape identical to that of stile 28 and adapted to be mounted on a wall of a building. Second upper rail 21 has a central vertical diaphragm plate 212 for seperating the cross-section area thereof into two equal parts 213, 214. Meeting stile 30 has a meeting side 301 near the line constituted by the middle points of the cross-sections of second left and right stiles 28 and has cross-section which includes a first end formed thereon a first receiving room 308 for receiving and securing therein a first side of closure body 35, an L-shaped flange 303 which is attached to the outer surface of meeting side 301, is near first receiving room 308 and has the vertical portion thereof parallel to the outer surface to form therebetween a receiving space 306, a second end formed thereon a second receiving room 309 and a grooved channel 304 formed on the outer surface and near second receiving room 309. A sealing piece 37 mounted in grooved channel 304 has a width capable of reaching the line and has a length equal to that of meeting stile 30. A straight flange 302 secured to the end edge of grooved channel 304 has a width extending to the above said line and is capable of engaging with the L-shaped flange 303 of another meeting stile 30 when the two meeting stiles 30 meet together. The inner side of each of second left and right stiles 28 is provided with a protrusion 281. The cross-section of first left(right) stile 29 has a first end formed thereon a first receiving room 292 for receiving and securing therein a second side of closure body 35 and a second end formed thereon a second receiving room receiving therein a cushioning piece 31 as shown in FIG. 10 by which the impact force between first left(right) stile 29 and second left(right) stile 28 is cushioned when first left(right) stile 29 is impacted upon second left(right) stile 28 and cushioning piece 31 is impacted upon protrusion 281. The inner side of second receiving room 291 is provided with a grooved channel 293 receiving therein a sealing piece 36 capable of engaging with a first surface 283 of protrusion 281 which has a second surface 282 engaging with a surface 311 of cushioning piece 31 for air-tight purposes when protrusion 281 engages with cushioning piece 31. Second lower rail 22 includes two parallel shallow socket channels 222, 223 each of which is to slide thereon a roller 33 as shown in FIG. 8 which carries the load of a closure with the present sashes. Between first and second receiving rooms 292, 291 of the first left(right) stile 29 there is formed a third receiving room 294. Two axial protrusions 331 acting as an axis of rotation of roller 33 are respectively provided on the two sides of roller 33. A roller mounting piece 32, as shown in FIG. 7, is capable of being received in third receiving room 294 or a third receiving room 305 formed between first and second receiving rooms 308, 309, has an indentation 324 which has a shape corresponding to that of roller 33 for receiving it therein and has a depth smaller than the diameter of roller 33 so that the rest portion of roller 33 not received in indentation 324 can slide along the arc surface of one of shallow socket channels 222, 223 and has a protrusion 322 having a grooved channel 321 which, when roller mounting piece 32 is received in third receiving room 294, is to be disposed alongside the outer side, which is the side near the outside of the building, of one of shallow socket channels 222, 223. The cross-section of first upper rail 23 includes a first end formed thereon a first receiving room 231 for receiving and securing therein a third side of closure body 35 and a second end having a grooved channel 233 positioned alongside central diaphragm plate 212 and a grooved channel 235 near one side of second upper rail 21 for receiving therein a sealing piece 26 which has a width capable of reaching the inner surface of the one side for air-tight purpose. The cross-section of the first lower rail is identical to that of first upper rail 23, is disposed upsidedown and includes a corresponding first end formed thereon a first receiving room 231′ for receiving and securing therein a fourth side of closure body 35 and a corresponding second end having a corresponding grooved channel 233′ positioned alongside the outer side of one of shallow socket channels 222, 223 for receiving therein a sealing piece 271 which has a width capable of reaching the outer surface of the outer side of the one of shallow socket channels 222, 223 for air-tight purposes and a corresponding grooved channel 235′ capable of being positioned above the inner side, which is the side near the inside of the building, of one of shallow socket channels 222, 223. An insert 25, as shown in FIG. 9, is capable of packing the room 232(234) formed among central vertical diaphragm plate 212, the inner portion of second upper rail 21 and the area above first left(right) stile 29 as shown in FIG. 6. A stabilizing piece 57 includes a first end capable of engaging with the inner side 228 of shallow socket channel 222 and a second end capable of engaging with corresponding grooved channel 235' for ensuring that roller 33 will not fall out of the shallow socket channel 222(223) upon which it slides. FIG. 12 shows how roller 33, roller mounting piece 32 and second lower rail 22 are in cooperation. The outer side of second upper rail 21 includes a first vertical plate 215 and a second vertical plate 216 which is parallel to and cooperates with first vertical plate 215 to form a first guiding room 217 therebetween. The outer side of second lower rail 22 is mounted thereon a curved flange 227 to form thereon a second guiding room. A netted closure 350 has an inner sash 24 which as an upper rail capable of being guided to slide within first guiding room 217, has a lower rail capable of being guided to slide within the second guiding room and includes a rail-stile connector 38, as shown in FIG. 25, which includes a first protrusion 382 capable of engaging with a rail of inner sash 24, a second protrusion 383 positioned perpendicular to first protrusion 382 and capable of engaging with a stile of inner sash 24 and a C-shaped flange 381 which is attached to the outer surface of the outer side of connector 38, has the central portion thereof capable of being parallel to the outer surface of connecter and has the lower portion thereof being capable of extending into a bottom space 226 of second lower rail 22 and engaging with the bottom surface of curved flange 227. A lock body 307, secured in second receiving room 309 of a meeting stile 30, engages with a plate lock hook 34, as shown in FIG. 11, which is capable of fixedly hooking thereon lock body 307 and includes a lower portion 341 which is capable of being inserted into receiving space 306 and has a first side capable of engaging with the outer surface of meeting side 301 and a second side which is the side opposite to the first side and capable of cooperating with the vertical portion of L-shaped flange 303 to form therebetween a screwing space by which plate lock hook 34 is secured in receiving space 306 when a screw 39 is screwed into the screwing space. In addition, it can be noticed from FIG. 4 that second lower rail 22 only contains a water accumulating room 224 and the water possibly contained therein can be drained away by drilling holes (not shown) beneath shallow socket channel 222.

Figure 16:
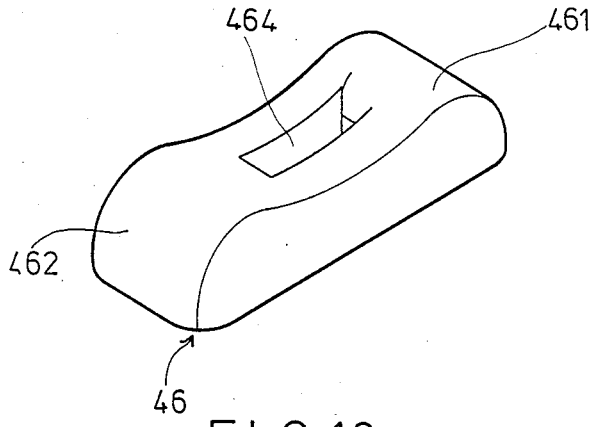
FIG. 16 is a perspective view showing a C-shaped piece for securing together an extending rail or stile and a grille frame of the present invention.
Figure 18:
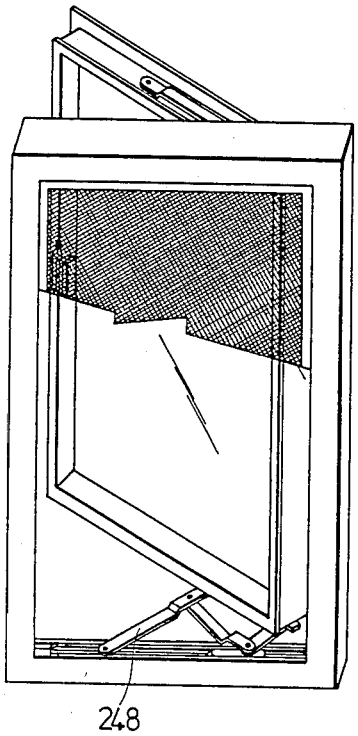
FIG. 18 is a perspective view of the closure shown in FIG. 17 according to the present invention.
Figure 20:
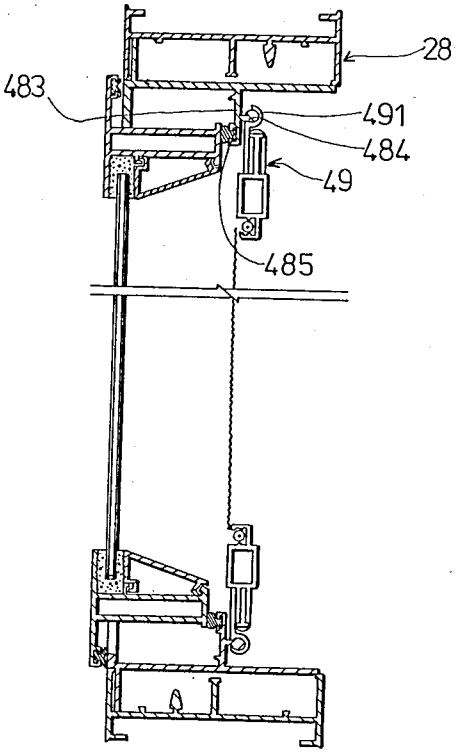
FIG. 20 is a sectional view showing a structure of the present invention for the closure shown in FIG. 17 along the B—B direction.
Figure 19:
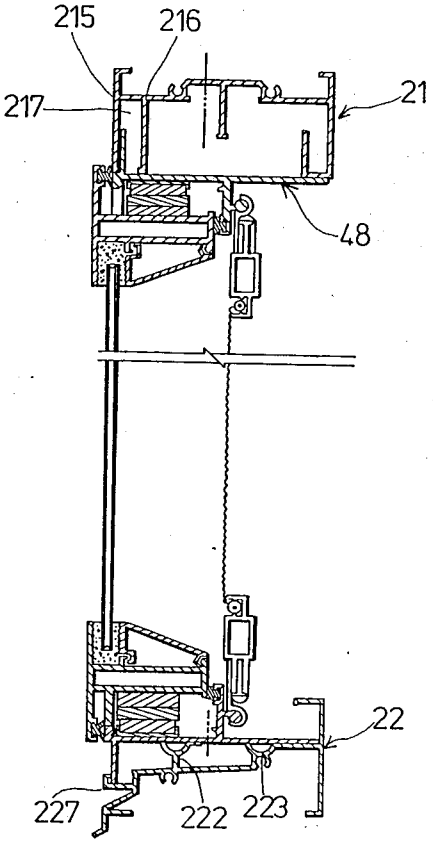
FIG. 19 is a sectional view showing a structure of the present invention for the closure shown in FIG. 17 along the A—A direction.
Figure 21:
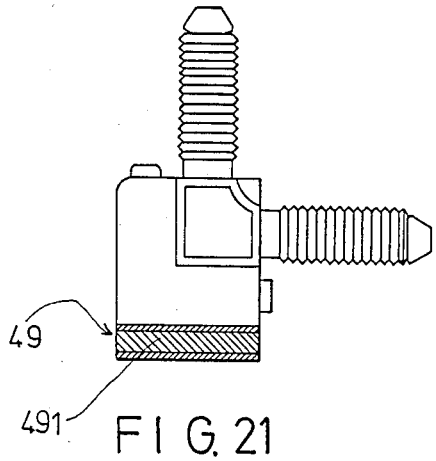
FIG. 21 is a partially sectional view showing a rail-stile connector for an inner sash of a netted closure in connection with the type of the closure shown in FIG. 17.

FIGS. 13–16 show further a closure of the sliding type. The sashes for such a closure further includes an intermediate rail 41 which is positioned between and parallel to second upper rail 21 and second lower rail 22 and is constituted by a third lower rail 414 identical to second lower rail 22 in cross-section and a third upper rail 415 identical to second upper rail 21 in cross-section with third upper rail 415 positioned right beneath and parallel to third lower rail 414. A grille 43 has a homogenized frame which includes a fourth upper rail, a fourth lower rail, a fourth left stile and a fourth right stile all of which bear the same cross-section 42 which includes a first end formed a receiving room 421 for receiving therein a side of grille 43 and a second end having the outer side thereof formed with a grooved channel 422 receiving therein a side 441 of a netted closure 44 and inner side thereof formed with a fifth grooved channel 424. There is further provided with an extending rail 45 which is engagable with and capable of being secured outside of and against first guiding room 217 or the second guiding room 218 formed by curved flange 227. Second vertical plate 216 has a protrusion 2171 engagable with a corresponding protrusion 2172 formed on the inner side of extending rail 45 (Such engagement also occurs to third upper rail 415). The outer side of extending rail 45 has a vertical plate 452 positioned on the outside of third upper rail 415 and a grooved channel 454 positioned right above grooved channel 424 so that two bent end portions 461, 462 of a C-shaped piece 46, as shown in FIG. 16, are capable of being securely engaging with grooved channels 424, 454 respectively. C-shaped piece 46 has a central groove 464 so that C-shaped piece 46 can securely engage with grooved channels 424, 454 by initially engaging a screwdriver with central groove 464 in a horizontal direction and then, turning C-shaped piece 46 to an upright position. There is further provided an extending stile 47 which is engagable with and capable of being secured outside of and against the outer side of second left stile 28 when viewing from the outside of the building and the outer side of the second right rail 28. The inner surface of the outer side of second left stile 28 is provided with two protrusions 285, 287 and the inner side of extending stile 47 is provided with two corresponding protrusions 472, 476 respectively engagable with protrusions 285, 287. It can be noticed that the outer side of extending stile 47 bears a cross-section identical to that of the outer side of extending rail 45. FIGS. 17–21 show a revolvable closure incorporated thereon the outer sash of the present invention. Such a closure is provided with an extending structure 48 which is capable of being disposed upon any one of second upper rail 21, lower rail 22, left and right stiles 28. The inner sash for such a closure can be any of the conventional types and is capable of, through extending structure 48, matching with the outer sash. A sliding mechanism 248 can also be any one of the conventional types and is secured between the outer sash and extending structure 48 to enable the inner sash to rotate in a relative rotation with respect to the outer sash. Extending structure 48 includes a plate protrusion 483 which further includes a grooved channel 485 receiving therein a sealing piece which can sealingly engage with the inner sash. Plate protrusion 483 further includes a cylindrical protrusion 484 formed on the side opposite to that formed grooved channel 485. A netted closure has an enclosing sash which includes an upper rail, a lower rail, a left stile and a right stile, between each rail and stile of which there is a rail-stile connector 49, as shown in FIG. 21, having an arc flange 491 matchable with cylindrical protrusion 484 with one of the four arc flanges 491 of the four rail-stile connecters 49 capable of being revolvably and firmly engaging with one of the four cylindrical protrusions 484 of the four extending structures 48.

Figure 22:
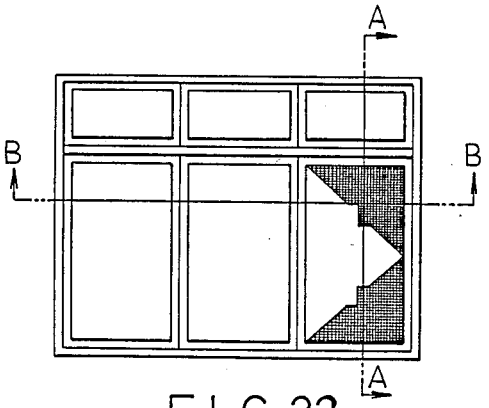
FIG. 22 is a front view showing further a closure of the sliding type.
Figure 23:
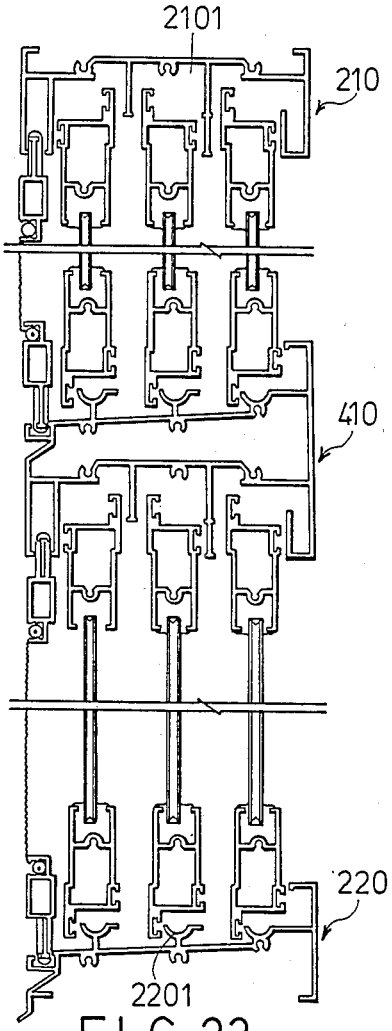
FIG. 23 is a sectional view showing a structure of the present invention for the closure shown in FIG. 22 along the A—A direction.
Figure 24:
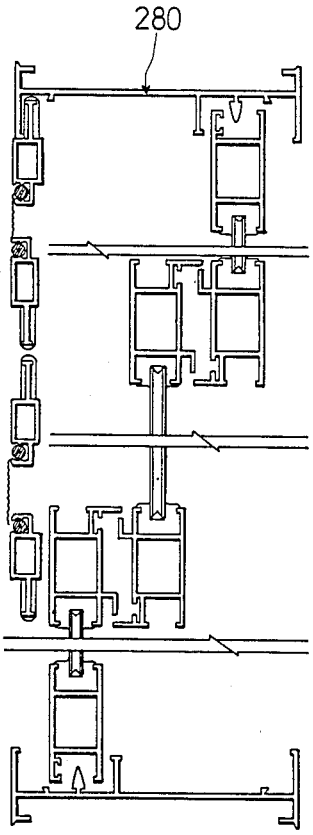
FIG. 24 is a sectional view showing a structure of the present invention for the closure shown in FIG. 22 along the B—B direction.

FIGS. 22–24 show further a sliding type closure incorporated with the sashes of the present invention. The cross-section of the second upper rail 210 is obtained by having the central portion of second upper rail 21 lengthened to form a central guiding room 2101 which is capable of guiding therein first upper rail 23. The cross-section of the second lower rail 220 is obtained by having the central portion of second lower rail 22 lengthened to form thereon a third shallow socket channel 2201 which is similar to either one of shallow socket channels 222, 223 in structure. The cross-section of the intermediate rail 410 can be obtained in a similar manner. The cross-section of the second left stile 280 is obtained by having the central portion of second left stile 28 lengthened by a length equal to that of the lengthened cross-section of either one of second upper and lower rails 21, 22.

Figure 26A:
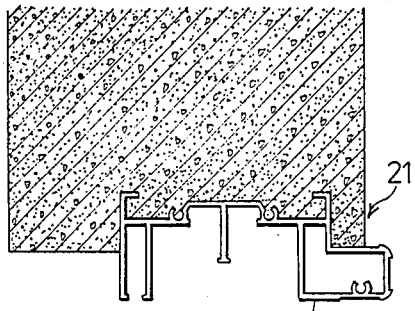
FIG. 26A is an end view for showing a side frame of the second upper rail of the present invention.
Figure 26E:
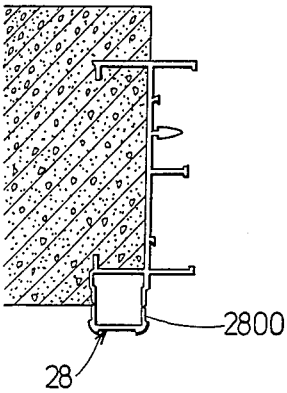
FIG. 26E is an end view for showing a side frame of the second right stile of the present invention.
Figure 26B:
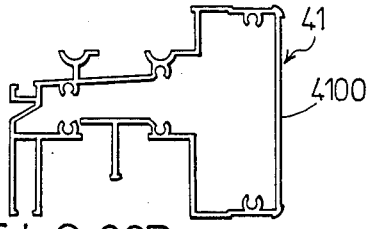
FIG. 26B is an end view for showing a side frame of the intermediate rail of the present invention.
Figure 26F:
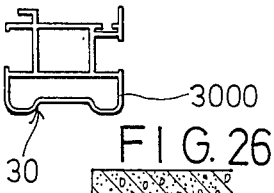
FIG. 26F is an end view for showing a side frame of the meeting stile of the present invention.
Figure 26C:
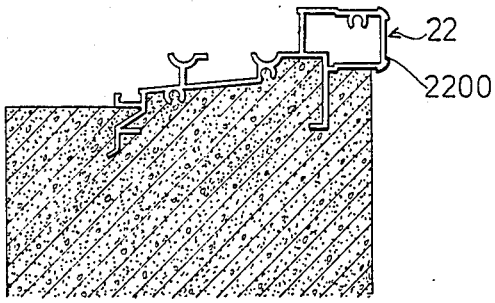
FIG. 26C is an end view for showing a side frame of the second lower rail of the present invention.
Figure 26D:
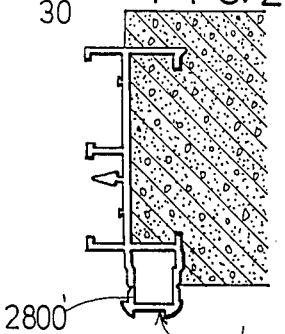
FIG. 26D is an end view for showing a side frame of the second left stile of the present invention.

Each of the inner side of second upper rail 21, the inner side of intermediate rail 41, the inner side of second lower rail 22, the inner side of second left stile 28, which is the stile positioned at the left side when viewong from the outside of the building, and the inner side of second right stile 28' is respectively provided with one of the side frames 2100, 4100, 2200, 2800 and 2800' the side surface of the inner side of which is incapable of being submerged into the plane which is constituted by the surface of the inner side of the wall as shown in FIGS. 26A–26F wherein FIG. 26F shows that the side, which is the side opposite to meeting side 301, of meeting stile 30 is provided with a side frame 3000 which when positioned at the inner side of meeting stile 30 is capable of being coplanar with side frames 2100, 4100, 2200, 2800 & 2800' of the outer sash. Thus, the wall can be more easily decorated than that which mounts thereon an outer sash to form a shoulder portion like that 121 shown in the prior art figures.

Figure 27:
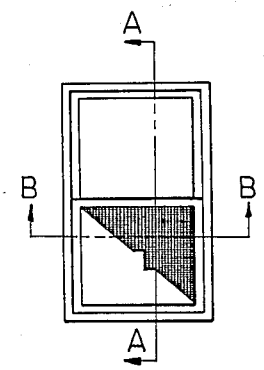
FIG. 27 is a front view of an additional closure of the sliding type.
Figure 28:
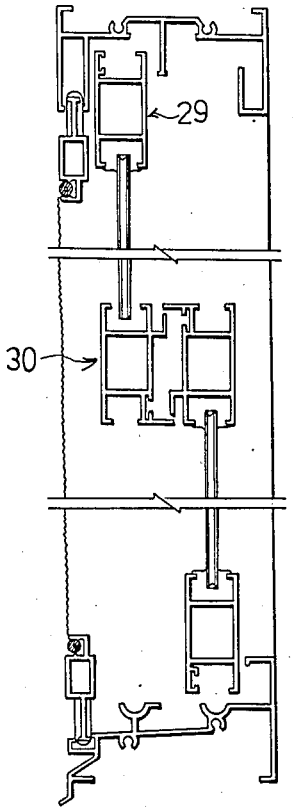
FIG. 28 is a sectional view showing a structure of the present invention for a closure in a closed situation of the type shown in FIG. 27 along the A—A direction.
Figure 29:
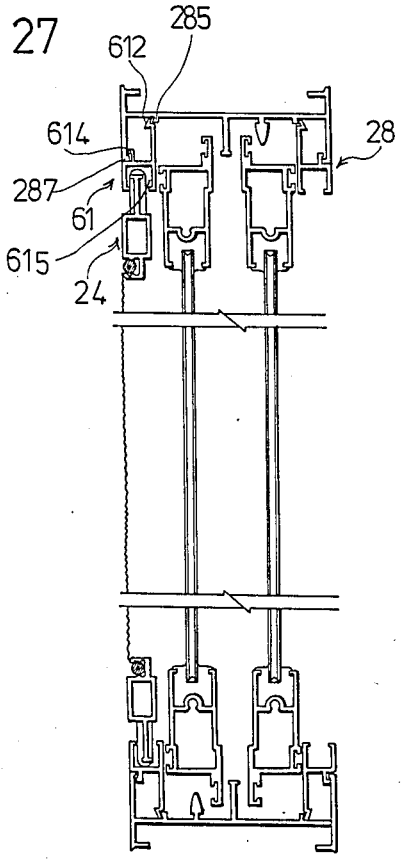
FIG. 29 is a sectional view showing a structure of the present invention for a closure in an open situation of the type shown in FIG. 27 along the B—B direction.

FIGS. 27–29 show an additional closure of the sliding type which can incorporate into use the sashes of the present invention. The inner sash is rotated 90 degrees with first left(right) stile 29 kept vertically spaced from and parallel to meeting stile 30 to match with the outer sash. Such sashes further include an extending stile 61 which includes two protrusions 612, 614 respectively engagable with protrusions 285, 287 of second left stile 28 for being secured thereon and is formed a receiving room 615 capable of receiving therein inner sash 24 of a netted closure. For further securing extending stile 61 on second left stile 28, a screw may be provided with to fasten along the dotted line as shown. It should be noted that for assembling such sashes, the inner sash must be put in the outer sash before extending stile 61 is engaged with second left stile 28.

While the invention has been described in connection with what is presently considered to be the most practical and preferred embodiments, it is to be understood that the the invention is not limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What I claim is:

1. Sashes for a closure comprising an outer sash defining a window opening; a pair of relatively moveable, overlapping inner sashes mounted within said outer sash for opening and closing said window opening; said inner sash including a first upper rail, a first lower rail, a first left stile and a first right stile and being adapted to enclose therein a closure body; said outer sash including a second upper rail, a second lower rail, a second left stile and a second right stile and being adapted to be mounted on a wall of a building;

said second upper rail including a central vertical diaphragm plate for separating the cross-sectional area of said second upper rail into two equal parts;

said second lower rail including two parallel shallow socket channels;

the inner side of said second left stile having a protrusion;

said second right stile being identical to said second left stile in shape;

the cross-section of said first upper rail including a first end formed with a first receiving room for receiving and securing therein one side of said closure body and a second end having a third grooved channel positioned alongside said central vertical diaphragm plate and a fourth grooved channel near one side of said second upper rail;

the cross-section of said first lower rail being identical to that of said first upper rail and being disposed upside down and including a corresponding first end formed with a first receiving room for receiving and securing therein one side of said closure body and corresponding second end having a corresponding third grooved channel positioned alongside said outer side of one of said shallow socket channel and a corresponding fourth grooved channel capable of being positioned above the inner side;

said first left stile being a meeting stile and having a cross-section including a first end formed thereon a first receiving room for receiving and securing therein one side of said closure body and an L-shaped flange attached to the outer surface of said meeting side, near said first receiving room and having the vertical portion of the "L" section parallel to said outer surface to form therebetween a receiving space and a first grooved channel formed on said outer surface and near said second receiving room and a straight flange secured to the end edge of said first grooved channel and having a width extending to terminate on the meeting line;

the cross-section of said first right stile having a first end formed thereon a first receivng room for receiving and securing therein one side of said closure body and a second end formed thereon a second receiving room receiving therein a cushioning piece and the inner side of said second receiving room receiving said cushioning piece having a second grooved channel receiving therein a sealing piece.

2. Sashes for a closure according to claim 1 further comprising:

two third receiving rooms each of which is formed between said first and second receiving rooms of said first right stile;

two axial protrusions respectively provided on the two sides of said roller; and a roller mounting piece capable of being received in one of said third receiving rooms, having an indentation which has a shape corresponding to that of said roller for receiving it therein and has a depth smaller than the diameter of said roller so that the rest portion of said roller not received in said indentation can slide on the arc surface of one of said shallow channels, and having a grooved channel alongside the outer side, which is the side near the outside of said building of one of said shallow socket channels.

3. Sashes for a closure according to claim 1 wherein said outer side of said second upper rail includes a first vertical plate and a second vertical plate which is parallel to said first vertical plate and cooperates with said first vertical plate to form a first guiding room therebetween.

4. Sashes for a closure according to claim 3 wherein said outer side of said second lower rail is mounted thereon a curved flange to form thereon a second guiding room.

5. Sashes for a closure according to claim 4 further comprising a netted closure with an inner sash which has an upper rail capable of being guided to slide within said first guiding room, has a lower rail capable of being guided to slide within said second guiding room and includes a rail-stile connector which includes a first protrusion capable of engaging with a rail of said inner sash of said netted closure, a second protrusion positioned perpendicular to said first protrusion and capable of engaging with a stile of said inner sash of said netted closure and a C-shaped flange which is attached to the outer surface of said outer side of said connector, has the central portion thereof capable of being parallel to said outer surface of said connector and has the lower portion thereof being capable of engaging with the bottom surface of said curved flange.

6. Sashes for a closure according to claim 1 further comprising an intermediate rail which is positioned between and parallel to said second upper rail and said second lower rail and is constituted by a third lower rail identical to said second lower rail in cross-section and a third upper rail identical to said second upper rail in cross-section and a third upper rail identical to said second upper rail in cross-section with said third upper rail positioned right beneath and parallel to said third lower rail.

7. Sashes for a closure according to claim 6 further comprising a grille with a frame which includes a fourth upper rail, a fourth lower rail, a fourth left stile and a fourth right stile all of which bear the same cross-section with includes:

a first end formed with a receiving room for receiving therein a side of said grille; and a second end having said outer side thereof formed a grooved channel adapted to receive therein a side of a netted closure and said inner side thereof formed a fifth grooved channel.

8. Sashes for a closure according to claim 7 further comprising an extending rail which is engageable with and capable of being secured outside of and against one of said first guiding room and second guiding room.

9. Sashes for a closure according to claim 8 further comprising a C-shaped piece and wherein:

said second vertical plate has a second protrusion; said inner side of said extending rail has a corresponding protrusion capable of engaging with said second protrusion; and said outer side of said extending rail has a third vertical plate positioned at said outside of said third upper rail and a sixth grooved channel positioned right above said fifth grooved channel so that said C-shaped piece has two end portions thereof capable of being securely engaging with said fifth and sixth grooved channels, respectively.

10. Sashes for a closure according to claim 9 further comprising an extending stile which is engageable with and capable of being secured outside of and against one of said outer side, the inner surface of which is provided with two third protrusions, of said second left stile when viewing from the outside of said building said outer side of said second right stile.

11. Sashes for a closure according to claim 10 wherein:

said inner side of said extending stile is provided with two corresponding protrusions which are capable of engaging with said third protrusions respectively to enable said extending stile engageable with and capable of being secured outside of and against said outer side of said second left stile; and said outer side of said extending stile bears a cross-section identical to that of said outer side of said extending rail.

12. Sashes for a closure according to claim 1 wherein:

the cross-section of said second upper rail has the central portion thereof lengthened to form a central guiding room which is capable of guiding therein said first upper rail;

the cross-section of said second lower rail has the central portion thereof lengthened to form thereon a third shallow socket channel which is similar to either one of said shallow socket channels in structure; and the cross-section of said second left stile has the central portion thereof lengthened by a length equal to that lengthened in said cross-section of either one of said second upper and lower rails.

13. Sashes for a closure according to claim 6 wherein each of said inner side of said second upper rail, said inner side of said intermediate rail, said inner side of said second lower rail, said inner side of said second left stile, which is the stile positioned at the left side when viewing from the outside of said building, and said inner side of said second right stile is provided with a side frame the side surface of said inner side of which is incapable of being submerged into the plane which is constituted by the surface of said inner side of said wall.

14. Sashes for a closure according to claim 13 wherein the side, which is the side opposite to said meeting side, of said meeting stile is provided with a side frame which when positioned at said inner side of said meeting stile is capable of being coplanar with the side frames of said outer sash.

* * * * *